US011670211B1

(12) United States Patent
Lin et al.

(10) Patent No.: US 11,670,211 B1
(45) Date of Patent: Jun. 6, 2023

(54) DISPLAY AND A MULTI-LEVEL VOLTAGE GENERATOR THEREOF

(71) Applicant: Himax Technologies Limited, Tainan (TW)

(72) Inventors: Yen-Hua Lin, Tainan (TW); Han-Shui Hsueh, Tainan (TW)

(73) Assignee: Himax Technologies Limited, Tainan (TW)

( * ) Notice: Subject to any disclaimer, the term of this patent is extended or adjusted under 35 U.S.C. 154(b) by 0 days.

(21) Appl. No.: 17/896,681

(22) Filed: Aug. 26, 2022

(51) Int. Cl.
*G09G 3/20* (2006.01)

(52) U.S. Cl.
CPC ..... *G09G 3/20* (2013.01); *G09G 2310/0275* (2013.01); *G09G 2330/028* (2013.01)

(58) Field of Classification Search
CPC ..... G09G 3/20; G09G 2310/0275; G09G 2330/028
See application file for complete search history.

(56) References Cited

U.S. PATENT DOCUMENTS 9,142,169 B2 * 9/2015 Cheng ..... G09G 3/36
2011/0205218 A1 * 8/2011 Tsuchi ..... G09G 3/3283 327/63

* cited by examiner

*Primary Examiner* — Gene W Lee
(74) *Attorney, Agent, or Firm* — Donald E. Stout; Stout, Uxa & Buyan, LLP

(57) ABSTRACT

A multi-level voltage generator includes P-type metal-oxide-semiconductor (PMOS) transistors that generate corresponding positive voltages and a common voltage respectively, each PMOS transistor having a source connected to corresponding generated voltage, and a drain connected to an output node to provide the corresponding generated voltage; N-type metal-oxide-semiconductor (NMOS) transistors that generate corresponding negative voltages and the common voltage respectively, each NMOS transistor having a source connected to corresponding generated voltage, and a drain connected to the output node to provide the corresponding generated voltage; and body-voltage selectors that adaptively select a body voltage for the plurality of PMOS transistors and NMOS transistors respectively, except PMOS transistor associated with a highest positive voltage and NMOS transistor associated with a lowest negative voltage with body and source connected together.

18 Claims, 5 Drawing Sheets

| Q2 | Q1 | Q0 | SOUT | NVSS | NVSSB | NVN3 | NVN2 | NVN1 | NVP1 | NVP2 | NVP3 |
|---|---|---|---|---|---|---|---|---|---|---|---|
| 0 | 0 | 0 | VSS | 0 | 1 | 0 | 0 | 0 | 1 | 1 | 1 |
| 0 | 0 | 1 | VN3 | 1 | 0 | 1 | 0 | 0 | 1 | 1 | 1 |
| 0 | 1 | 0 | VN2 | 1 | 0 | 0 | 1 | 0 | 1 | 1 | 1 |
| 0 | 1 | 1 | VN1 | 1 | 0 | 0 | 0 | 1 | 1 | 1 | 1 |
| 1 | 0 | 0 | VP1 | 1 | 0 | 0 | 0 | 0 | 0 | 1 | 1 |
| 1 | 0 | 1 | VP2 | 1 | 0 | 0 | 0 | 0 | 1 | 0 | 1 |
| 1 | 1 | 0 | VP3 | 1 | 0 | 0 | 0 | 0 | 1 | 1 | 0 |
| 1 | 1 | 1 | - | 1 | 0 | 0 | 0 | 0 | 1 | 1 | 1 |

*FIG. 3*

DISPLAY AND A MULTI-LEVEL VOLTAGE GENERATOR THEREOF

BACKGROUND OF THE INVENTION

1. Field of the Invention

The present invention generally relates to a voltage generator, and more particularly to a multi-level voltage generator adaptable to an electronic paper display.

2. Description of Related Art

An electronic paper display (EPD), also called electrophoretic display, is a display device that contains charged electrophoretic particles to imitate the appearance of ordinary ink or paper. The electronic paper display reflects light instead of emitting light as in a conventional flat panel display such as liquid crystal display.

The electronic paper displays, particularly the color displays, commonly include a source driver outputting multiple voltage levels, some of which may ordinarily suffer substrate body effect, according to which the body may influence the corresponding threshold voltage by the change in the source-bulk voltage, thereby substantially degrading driving capability of the source driver.

A need has thus arisen to propose a novel scheme to overcome drawbacks of the conventional electronic paper displays.

SUMMARY OF THE INVENTION

In view of the foregoing, it is an object of the embodiment of the present invention to provide a multi-level voltage generator with enhanced driving capability adaptable to a source driver of an electronic paper display (EPD).

According to one embodiment, a multi-level voltage generator includes P-type metal-oxide-semiconductor (PMOS) transistors, N-type metal-oxide-semiconductor (NMOS) transistors and body-voltage selectors. The PMOS transistors generate corresponding positive voltages and a common voltage respectively, each PMOS transistor having a source connected to corresponding generated voltage, and a drain connected to an output node to provide the corresponding generated voltage. The NMOS transistors generate corresponding negative voltages and the common voltage respectively, each NMOS transistor having a source connected to corresponding generated voltage, and a drain connected to the output node to provide the corresponding generated voltage. The body-voltage selectors adaptively select a body voltage for the plurality of PMOS transistors and NMOS transistors respectively, except PMOS transistor associated with a highest positive voltage and NMOS transistor associated with a lowest negative voltage with body and source connected together.

BRIEF DESCRIPTION OF THE DRAWINGS

FIG. 3 shows a truth table illustrating the relationship among the encoded inputs, the generated voltage at the output node, and the decoded outputs;

DETAILED DESCRIPTION OF THE INVENTION

Figure 1:
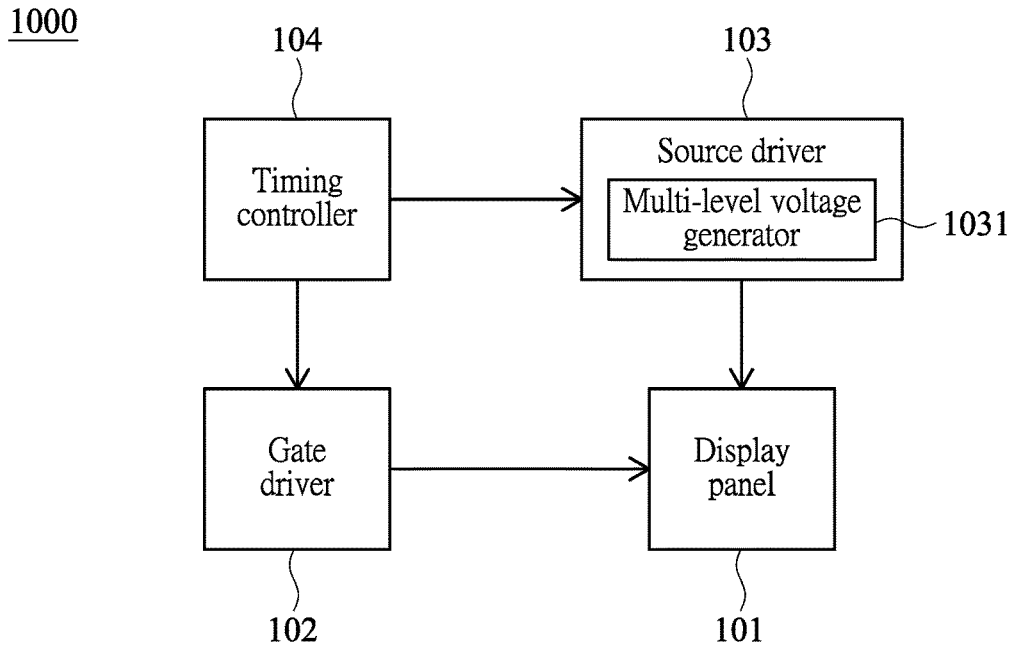
FIG. 1 shows a block diagram illustrating an electronic paper display (EPD) according to one embodiment of the present invention.

FIG. 1 shows a block diagram illustrating an electronic paper display (EPD) 1000 according to one embodiment of the present invention. Specifically, the EPD 1000 may include a display panel 101 composed of a plurality of pixels arranged in a matrix form. The EPD 1000 may include a gate driver 102 configured to turn on at least one row of pixels of the display panel 101; and a source driver 103 configured to provide image data to pixels of the turn-on row. In the embodiment, the source driver 103 may include a multi-level voltage generator 1031 configured to generate multiple voltage levels. The EPD 1000 may include a timing controller 104 configured to controllably coordinate the gate driver 102 and the source driver 103.

Figure 2B:
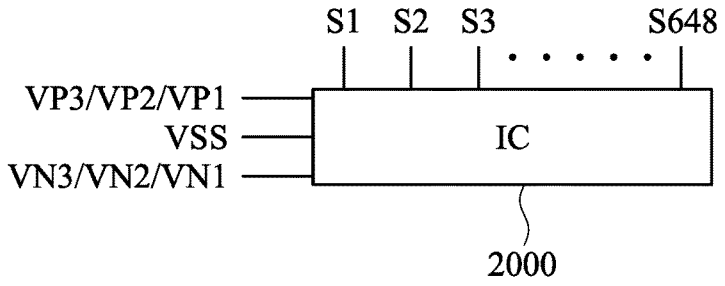
FIG. 2B shows a block diagram exemplifying an integrated circuit (IC) adapted to control multiple channels of the source driver.
Figure 2C:
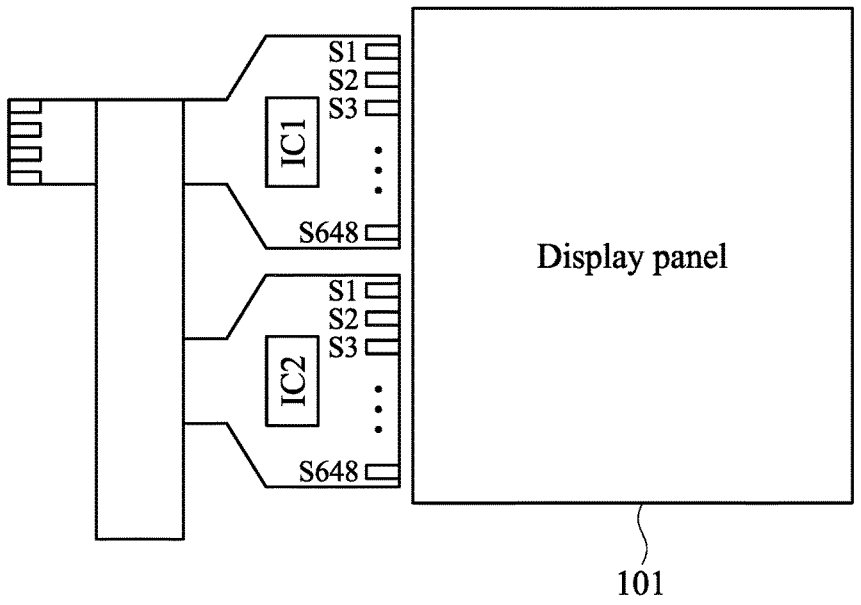
FIG. 2C shows a schematic diagram exemplifying two ICs each adapted to control channels of the source driver to controllably provide image data to the display panel.
Figure 2A:
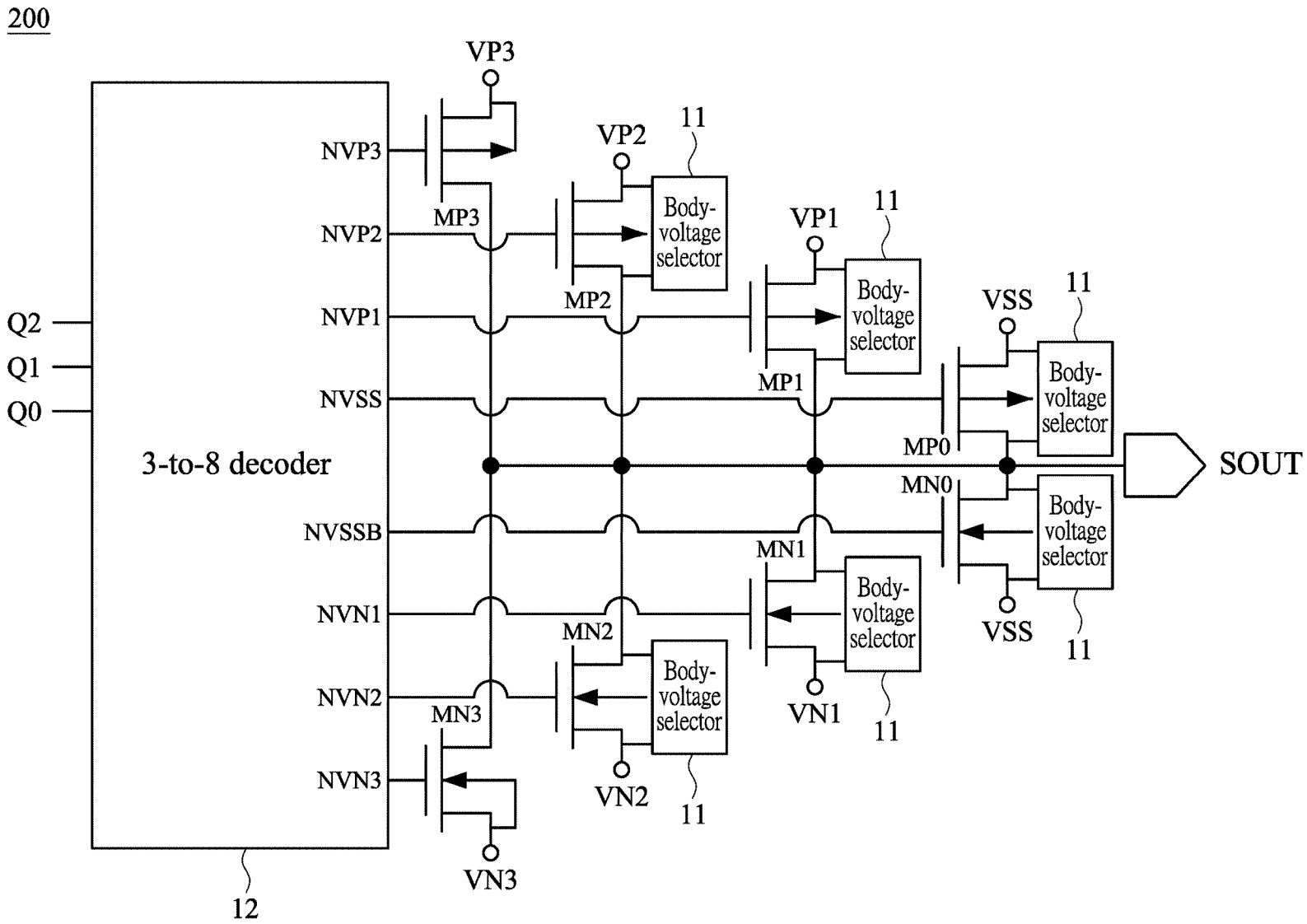
FIG. 2A shows a circuit diagram illustrating a multi-level voltage generator according to a first embodiment of the present invention.

FIG. 2A shows a circuit diagram illustrating a multi-level voltage generator 200 according to a first embodiment of the present invention. The multi-level voltage generator 200 may be adaptable to, but not limited to, a source driver 103 of an electronic paper display (EPD) 1000 as exemplified in FIG. 1. It is noted that the multi-level voltage generator 200 as shown in FIG. 2A may be adapted to one channel (or column) of the source driver 103. FIG. 2B shows a block diagram exemplifying an integrated circuit (IC) 2000 adapted to control multiple (e.g., 648) channels S1 through S648 of the source driver 103. FIG. 2C shows a schematic diagram exemplifying two ICs (e.g., IC1 and IC2) each adapted to control 648 channels of the source driver 103 to controllably provide image data to the display panel 101.

In the embodiment, referring back to FIG. 2A, the multi-level voltage generator 200 may include a plurality of P-type metal-oxide-semiconductor (PMOS) transistors configured to generate corresponding positive voltages and a common voltage respectively. Generally speaking, the plurality of PMOS transistors may include n+1 PMOS transistors (n is a positive integer) composed of MPn, MPn-1 . . . MP1 and MP0 configured to generate corresponding positive voltages VPn, VPn-1 . . . VP1 and the common voltage VSS respectively. In the embodiment as exemplified in FIG. 2A, the plurality of PMOS transistors may include 4 PMOS transistors (n is equal to 3) composed of MP3, MP2, MP1 and MP0 configured to generate corresponding positive voltages VP3, VP2, VP1 and the common voltage VSS respectively.

Similarly, the multi-level voltage generator 200 may include a plurality of N-type metal-oxide-semiconductor (NMOS) transistors configured to generate corresponding negative voltages and the common voltage respectively. Generally speaking, the plurality of NMOS transistors may include n+1 NMOS transistors (n is a positive integer) composed of MNn, MNn-1 . . . MN1 and MN0 configured to generate corresponding negative voltages VNn, VNn-1 . . . VN1 and the common voltage VSS respectively. In the embodiment as exemplified in FIG. 2A, the plurality of NMOS transistors may include 4 NMOS transistors (n is equal to 3) composed of MN3, MN2, MN1 and MN0 configured to generate corresponding negative voltages VN3, VN2, VN1 and the common voltage VSS respectively.

Specifically, each PMOS transistor has a source connected to the corresponding generated voltage (i.e., positive voltage or the common voltage), and a drain connected to an output node SOUT to provide the corresponding generated voltage (i.e., positive voltage or the common voltage). Each NMOS transistor has a source connected to the corresponding generated voltage (i.e., negative voltage or the common voltage), and a drain connected to an output node SOUT to provide the corresponding generated voltage (i.e., negative voltage or the common voltage).

According to one aspect of the embodiment, the multi-level voltage generator 200 may include a plurality of body-voltage selectors 11 configured to dynamically or adaptively select a body voltage (or bulk voltage) for the plurality of PMOS transistors and NMOS transistors respectively, except the PMOS transistor associated with a highest positive voltage VPn and the NMOS transistor associated with a lowest negative voltage VNn with body and source connected together.

Specifically, each body-voltage selector 11 detects voltages at the source and the drain of corresponding (PMOS or NMOS) transistor, and accordingly selects a proper body-voltage that is then coupled to body (or back gate) of the corresponding (PMOS or NMOS) transistor. For example, when voltage at the drain is greater than voltage at the source, the voltage at the drain is then coupled to the body of the corresponding (PMOS or NMOS) transistor; and when voltage at the drain is less than voltage at the source, the voltage at the source is then coupled to the body of the corresponding (PMOS or NMOS) transistor.

In the embodiment, the multi-level voltage generator 200 may include a decoder 12 configured to assert (or activate) one of a plurality of decoded outputs for each encoded input. Generally speaking, the decoder 12 may include an n-to-$2^n$ decoder (n is a positive integer) configured to assert one of $2^n$ decoded outputs for each encoded input $Q_{n-1}Q_{n-2} \ldots Q_0$. In the embodiment as exemplified in FIG. 2A, the decoder 12 may include a 3-to-8 decoder (n is equal to 3) configured to assert one of 8 decoded outputs for each encoded input Q2Q1Q0.

Specifically, the decoded outputs are connected to gates of corresponding (PMOS or NMOS) transistors respectively. In the embodiment as exemplified in FIG. 2A, the decoded outputs NVP3, NVP2, NVP1 and NVSS are connected to gates of PMOS transistors MP3, MP2, MP1 and MP0 respectively, and the decoded outputs NVN3, NVN2, NVN1 and NVSSB are connected to gates of NMOS transistors MN3, MN2, MN1 and MNO respectively.

Accordingly, the asserted decoded output activates corresponding (PMOS or NMOS) transistor at a time, thereby generating corresponding (positive, negative or common) voltage at the output node SOUT.

FIG. 3 shows a truth table illustrating the relationship among the encoded inputs Q2, Q1 and Q1, the generated voltage at the output node SOUT, and the decoded outputs NVSS, NVSSB, NVN3, NVN2, NVN1, NVP1, NVP2 and NVP3.

Figure 4:
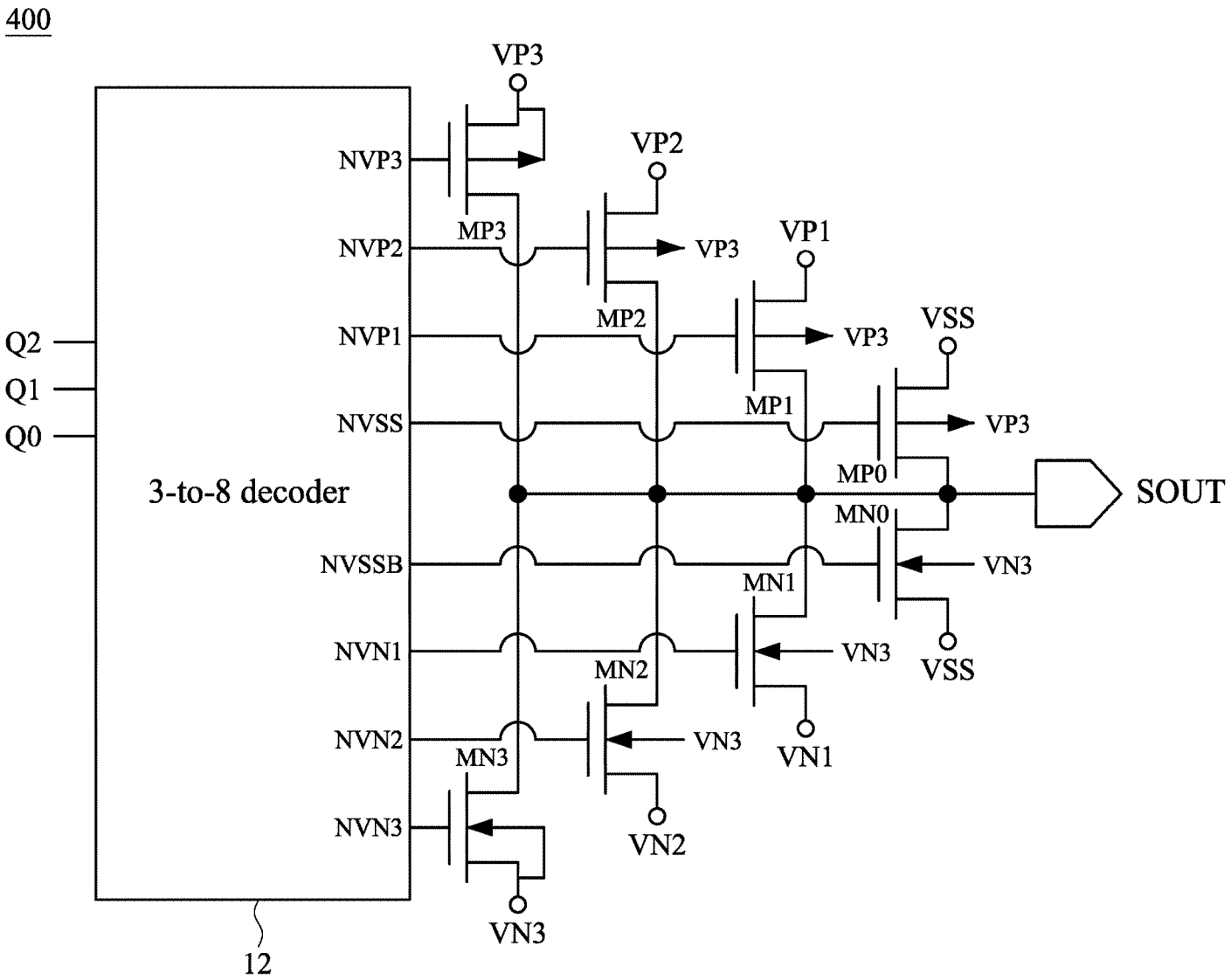
FIG. 4 shows a circuit diagram illustrating a multi-level voltage generator without adopting the scheme of FIG. 2A.

FIG. 4 shows a circuit diagram illustrating a multi-level voltage generator 400 without adopting the scheme of FIG. 2A. Specifically, body of each PMOS transistor is coupled to the highest positive voltage VP3, and body of each NMOS transistor is coupled to the lowest negative voltage VN3. The PMOS transistors and the NMOS transistors in the multi-level voltage generator 400 may suffer substrate body effect, according to which the body may influence the corresponding threshold voltage by the change in the source-bulk voltage. Accordingly, some PMOS transistors such as MP1 and MP2 and some NMOS transistors such as MN1 and MN2 may be subjected to degraded driving capability.

Figure 5:
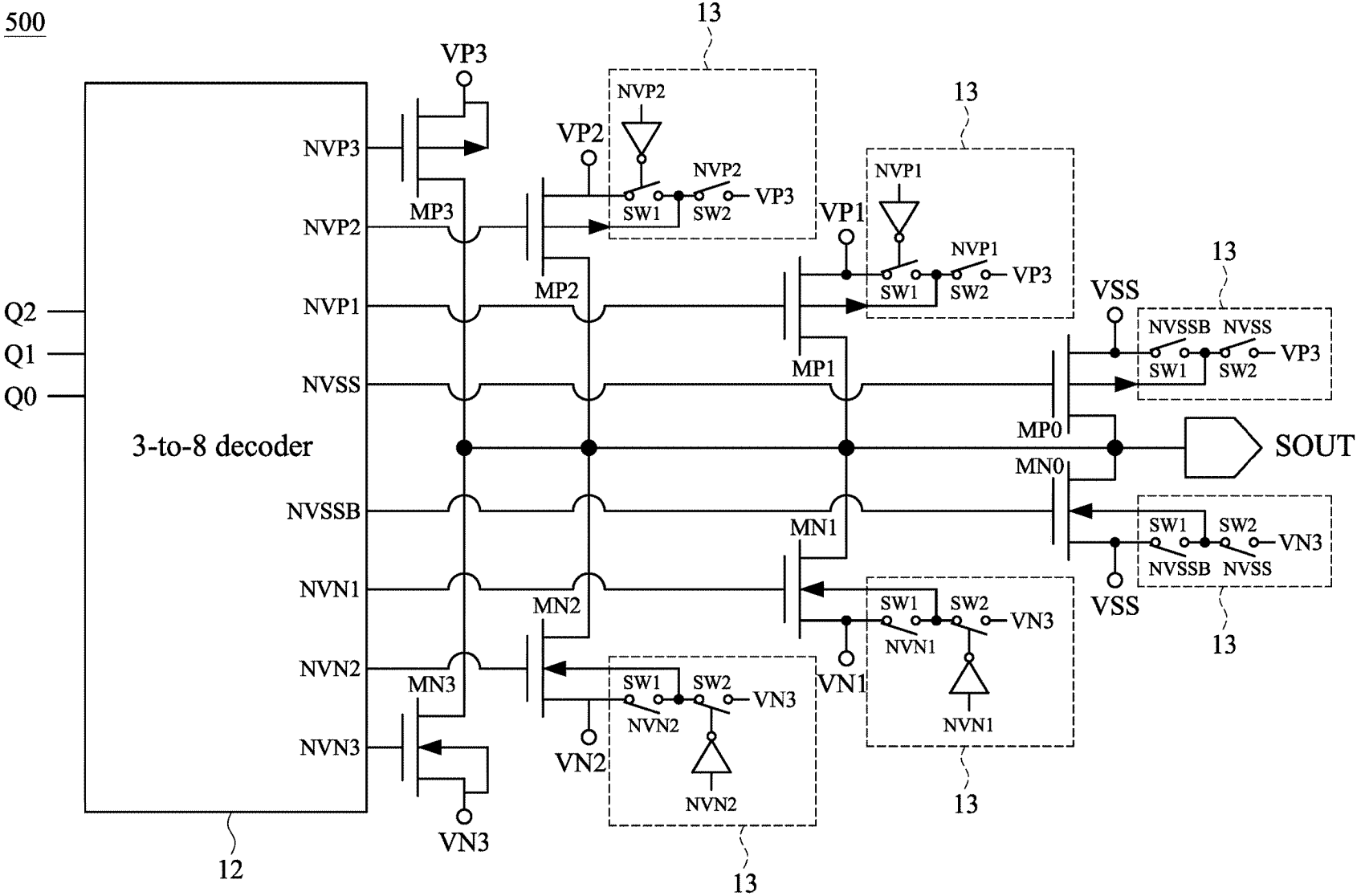
FIG. 5 shows a circuit diagram illustrating a multi-level voltage generator according to a second embodiment of the present invention.

FIG. 5 shows a circuit diagram illustrating a multi-level voltage generator 500 according to a second embodiment of the present invention. The multi-level voltage generator 500 of the present embodiment is similar to the multi-level voltage generator 200 of FIG. 2A with the exceptions that will be described below.

In the embodiment, the multi-level voltage generator 500 may include a plurality of body-voltage selectors 13 configured to dynamically or adaptively select a body voltage (or bulk voltage) for the plurality of PMOS transistors and NMOS transistors respectively, except the PMOS transistor associated with a highest positive voltage VPn (e.g., VP3 as exemplified in FIG. 4) and the NMOS transistor associated with a lowest negative voltage VNn (e.g., VN3 as exemplified in FIG. 4) with body and source connected together.

Specifically, each body-voltage selector 13 associated with the corresponding PMOS transistor may include a first switch SW1 and a second switch SW2. The first switch SW1 is connected between corresponding body and the corresponding generated voltage (or the corresponding source), and controlled by a corresponding inverted decoded output; the second switch SW2 is connected between the body and the highest positive voltage, and controlled by a corresponding decoded output. In the operation, when the PMOS transistor is activated by a corresponding asserted decoded output (e.g., active low), the corresponding generated voltage is coupled to the body via the turn-on first switch SW1 (while turning off the second switch SW2). Otherwise, when the PMOS transistor is not activated with the corresponding decoded output un-asserted, the highest positive voltage is coupled to the body via the turn-on second switch SW2 (while turning off the first switch SW1).

Similarly, each body-voltage selector 13 associated with the corresponding NMOS transistor may include a first switch SW1 and a second switch SW2. The first switch SW1 is connected between corresponding body and the corresponding generated voltage (or the corresponding source), and controlled by a corresponding decoded output; the second switch SW2 is connected between the body and the lowest negative voltage, and controlled by a corresponding inverted decoded output. In the operation, when the NMOS transistor is activated by a corresponding asserted decoded output (e.g., active high), the corresponding generated voltage is coupled to the body via the turn-on first switch SW1 (while turning off the second switch SW2). Otherwise, when the NMOS transistor is not activated with the corresponding decoded output un-asserted, the lowest negative voltage is coupled to the body via the turn-on second switch SW2 (while turning off the first switch SW1).

Although specific embodiments have been illustrated and described, it will be appreciated by those skilled in the art that various modifications may be made without departing from the scope of the present invention, which is intended to be limited solely by the appended claims.

What is claimed is:

1. A multi-level voltage generator, comprising:

a plurality of P-type metal-oxide-semiconductor (PMOS) transistors that generate corresponding positive voltages and a common voltage respectively, each PMOS transistor having a source connected to corresponding generated voltage, and a drain connected to an output node to provide the corresponding generated voltage;

a plurality of N-type metal-oxide-semiconductor (NMOS) transistors that generate corresponding negative voltages and the common voltage respectively, each NMOS transistor having a source connected to corresponding generated voltage, and a drain connected to the output node to provide the corresponding generated voltage; and a plurality of body-voltage selectors that adaptively select a body voltage for the plurality of PMOS transistors and NMOS transistors respectively, except PMOS transistor associated with a highest positive voltage and NMOS transistor associated with a lowest negative voltage with body and source connected together.

2. The multi-level voltage generator of claim 1, wherein each body-voltage selector detects voltages at source and drain of corresponding transistor, and accordingly selects a proper body-voltage that is then coupled to body of the corresponding transistor.

3. The multi-level voltage generator of claim 2, wherein the voltage at the drain is selected and coupled to the body of the corresponding transistor when the voltage at the drain is greater than the voltage at the source.

4. The multi-level voltage generator of claim 1, further comprising:

a decoder that asserts one of a plurality of decoded outputs for each encoded input, the decoded outputs being connected to gates of corresponding transistors respectively;

wherein the asserted decoded output activates corresponding transistor at a time, thereby generating corresponding voltage at the output node.

5. The multi-level voltage generator of claim 4, wherein each body-voltage selector selects and couples corresponding generated voltage to the body of corresponding PMOS transistor that is activated, otherwise the highest positive voltage is coupled to the body.

6. The multi-level voltage generator of claim 5, wherein each body-voltage selector comprises:

a first switch connected between corresponding body and the corresponding generated voltage, and controlled by a corresponding inverted decoded output; and a second switch connected between the body and the highest positive voltage, and controlled by a corresponding decoded output.

7. The multi-level voltage generator of claim 4, wherein each body-voltage selector selects and couples corresponding generated voltage to the body of corresponding NMOS transistor that is activated, otherwise the lowest negative voltage is coupled to the body.

8. The multi-level voltage generator of claim 7, wherein each body-voltage selector comprises:

a first switch connected between corresponding body and the corresponding generated voltage, and controlled by a corresponding decoded output; and a second switch connected between the body and the lowest negative voltage, and controlled by a corresponding inverted decoded output.

9. A display, comprising:

a display panel composed of a plurality of pixels;

a gate driver that turns on at least one row of pixels of the display panel; and a source driver that provides image data to pixels of the turn-on row, the source driver including a plurality of multi-level voltage generators each comprising:

a plurality of P-type metal-oxide-semiconductor (PMOS) transistors that generate corresponding positive voltages and a common voltage respectively, each PMOS transistor having a source connected to corresponding generated voltage, and a drain connected to an output node to provide the corresponding generated voltage;

a plurality of N-type metal-oxide-semiconductor (NMOS) transistors that generate corresponding negative voltages and the common voltage respectively, each NMOS transistor having a source connected to corresponding generated voltage, and a drain connected to the output node to provide the corresponding generated voltage; and a plurality of body-voltage selectors that adaptively select a body voltage for the plurality of PMOS transistors and NMOS transistors respectively, except PMOS transistor associated with a highest positive voltage and NMOS transistor associated with a lowest negative voltage with body and source connected together.

10. The display of claim 9, wherein the display comprises an electronic paper display.

11. The display of claim 9, further comprising:

a timing controller that controllably coordinates the gate driver and the source driver.

12. The display of claim 9, wherein each body-voltage selector detects voltages at source and drain of corresponding transistor, and accordingly selects a proper body-voltage that is then coupled to body of the corresponding transistor.

13. The display of claim 12, wherein the voltage at the drain is selected and coupled to the body of the corresponding transistor when the voltage at the drain is greater than the voltage at the source.

14. The display of claim 9, wherein each multi-level voltage generator further comprises:

a decoder that asserts one of a plurality of decoded outputs for each encoded input, the decoded outputs being connected to gates of corresponding transistors respectively;

wherein the asserted decoded output activates corresponding transistor at a time, thereby generating corresponding voltage at the output node.

15. The display of claim 14, wherein each body-voltage selector selects and couples corresponding generated voltage to the body of corresponding PMOS transistor that is activated, otherwise the highest positive voltage is coupled to the body.

16. The display of claim 15, wherein each body-voltage selector comprises:

a first switch connected between corresponding body and the corresponding generated voltage, and controlled by a corresponding inverted decoded output; and a second switch connected between the body and the highest positive voltage, and controlled by a corresponding decoded output.

17. The display of claim 14, wherein each body-voltage selector selects and couples corresponding generated voltage to the body of corresponding NMOS transistor that is activated, otherwise the lowest negative voltage is coupled to the body.

18. The display of claim 17, wherein each body-voltage selector comprises:

a first switch connected between corresponding body and the corresponding generated voltage, and controlled by a corresponding decoded output; and a second switch connected between the body and the lowest negative voltage, and controlled by a corresponding inverted decoded output.

* * * * *